US008522862B2

(12) United States Patent
Opferkuch et al.

(10) Patent No.: US 8,522,862 B2
(45) Date of Patent: Sep. 3, 2013

(54) VEHICLE RADIATOR

(75) Inventors: Frank Opferkuch, Unterensingen (DE); Jan Böbel, Reutlingen (DE); Axel Fezer, Stuttgart (DE); Klaus Mohrlok, Schlaitdorf (DE); Ulrich Schäffer, Filderstadt (DE)

(73) Assignee: Modine Manufacturing Company, Racine, WI (US)

( * ) Notice: Subject to any disclaimer, the term of this patent is extended or adjusted under 35 U.S.C. 154(b) by 762 days.

(21) Appl. No.: 12/669,264

(22) PCT Filed: Jun. 24, 2008

(86) PCT No.: PCT/EP2008/005065

§ 371 (c)(1),
(2), (4) Date: Apr. 26, 2010

(87) PCT Pub. No.: WO2009/010155

PCT Pub. Date: Jan. 22, 2009

(65) Prior Publication Data

US 2010/0218926 A1 Sep. 2, 2010

(30) Foreign Application Priority Data

Jul. 17, 2007 (DE) ..... 10 2007 033 177

(51) Int. Cl.
*F28D 1/053* (2006.01)

(52) U.S. Cl.
USPC ..... 165/153; 165/177

(58) Field of Classification Search
USPC ..... 165/152, 153, 173, 177, 181
See application file for complete search history.

(56) References Cited

U.S. PATENT DOCUMENTS

| | | | | |
|---|---|---|---|---|
| 3,232,343 | A * | 2/1966 | Lindstrand et al. | 165/148 |
| 4,693,307 | A | 9/1987 | Scarselletta | |
| 2005/0045314 | A1 | 3/2005 | Elbourini | |

FOREIGN PATENT DOCUMENTS

| | | |
|---|---|---|
| DE | 3020424 | 11/1981 |
| DE | 10060104 | 6/2001 |

OTHER PUBLICATIONS

International Search Report, PCT/EP2008/005065, Sep. 15, 2008.

(Continued)

*Primary Examiner* — Teresa Walberg
(74) *Attorney, Agent, or Firm* — Michael Best & Friedrich LLP

(57) ABSTRACT

The invention relates to a cooling fluid cooler for motor vehicles having a soldered cooling network (1) made of flat tubes (101) and ribs (102), produced from very thin aluminum sheets (a, b, c), and having header or loop-around chambers (3) at the ends of the flat tubes (101) for the cooling fluid flowing in the flat tubes (101), said chambers being cooled by cooling air flowing through the ribs (102). The cooling fluid cooler has exceptional cooling power and a light weight. This is achieved according to the invention in that each flat tube (101) is made of at least two formed sheet metal strips (a, b, c), wherein at least the one sheet metal strip (a, b) forms the wall of the flat tube and the other sheet metal strip forms a wavy internal insert (c) forming channels (10) in the same, and that the ratio of the constriction factor on the cooling fluid side to the constriction factor on the cooling air side is approximately in the range of 0.20 to 0.44, wherein the hydraulic diameter on the cooling fluid side is approximately in the range of 0.8 to 1.5 mm.

7 Claims, 7 Drawing Sheets

(56) References Cited

OTHER PUBLICATIONS

PCT/EP2008/005065 Written Opinion dated Feb. 18, 2010.
Chinese Office Action (Translation) for Application No. 200880025070.5, Nov. 29, 2010 (2 pages).
Search Report from the European Patent Office for Application No. 08759324.0 dated Mar. 24, 2010 (Original, 3 pages).
Second Office Action from the State Intellectual Property Office of China for Application No. 200880025070.5 dated Jul. 19, 2011 (English Translation—7 pages).

* cited by examiner

VEHICLE RADIATOR

CROSS-REFERENCE TO RELATED APPLICATIONS

This patent application is a national stage filing under 35 U.S.C. 371 of International Application No. PCT/EP2008/005065, filed 24 Jun. 2008, and claims priority to German Patent Application No. 10 2007 033 177.2, filed 17 Jul. 2007, the entire contents of which are incorporated herein by reference.

The invention relates to a coolant cooler for motor vehicles having a soldered cooling network composed of flat pipes and of ribs, manufactured from very thin sheets of aluminum and having collector or deflector boxes, arranged at the ends of the flat pipes, for the coolant which flows in the flat pipes and which is cooled by means of cooling air, which flows through the ribs.

The coolant cooler described at the beginning is the standard which has applied for years for such heat exchangers. The intention is that the invention described below will not basically change this standard rather optimize it in many respects.

Compact heat exchangers composed of flat pipes and louver-type lamellas are known from the prior art for cooling drive trains of vehicles having internal combustion engines. These are capable of achieving extremely high cooling capacity in an extremely small installation space. The objective of the optimization is not only to achieve a high volume-related power density but also minimum pressure loss on the coolant side and a low weight. At the same time, for reasons of strength, in particular owing to thermomechanical stresses and due to the stresses of the cooling network from pressure from the cooling system of the vehicle, the minimum wall thicknesses, in particular of the flat pipes, have to be selected such that they do not significantly counteract the other objectives, for example of reducing weight and achieving the smallest possible cross-sectional constrictions on the coolant side and on the cooling air side (compactness) accompanied by a low pressure loss. In the prior art, the flat pipes often have no internal supports, or only 1 to 2 internal supports. The pipe heights are in the range from 1.3 mm to 2.0 mm. For reasons of strength and corrosion, wall thicknesses of more than 0.20 mm are used at present. Inter alia the hydraulic diameter (4×area over which the flow passes/wetted area) is a characteristic variable for the hydraulic behavior. With the aforesaid parameters for the pipes without an internal insert, hydraulic diameters of 1.3 mm to 3.0 mm typically occur on the coolant side. Together with the lamellas with typical heights of 5.1 mm to 9.5 mm and wall thicknesses in the range of 60 μm to 120 μm a constriction factor (ratio of area flowed through to end area) results in the range from 0.05 to 0.28.

It is also known that internal inserts can be used to significantly improve the ability of the flat pipes to withstand internal pressure and thermomechanical loading. The problem is however that in flat pipes with internal inserts the hydraulic diameter is usually significantly smaller than in flat pipes without internal inserts, as a result of which the pressure loss rises.

A coolant cooler which, apart from one feature, has all the other features of the preamble of claim 1, is known from U.S. Pat. No. 4,332,293. The flat pipes there are composed of brass and the ribs of copper. This coolant cooler is therefore too heavy and too difficult. The same applies to the coolant cooler which is known from U.S. Pat. No. 5,329,988. A further coolant cooler is known from U.S. Pat. No. 4,693,307. In said document a solution is presented which limits the cooling air-side pressure loss through a special embodiment of the ribs.

The embodiment of the flat pipes used in coolant coolers does not seem to have been of particular interest until now because in the sources quoted flat pipes have been shown and described without any particular features.

The object of the invention is to make available a cost-effective coolant cooler for motor vehicles whose properties, such as in particular high thermal transmission power accompanied by a comparatively low weight, will be compatible with the future requirements of users in many respects.

The inventive solution of the problem is obtained in a coolant cooler embodied according to the preamble of claim by virtue of its configuration with the characterizing features of said claim.

Each flat pipe is composed of at least two shaped sheet metal strips, wherein at least one of the sheet metal strips forms the wall of the flat pipe and another sheet metal strip constitutes a corrugated internal insert, forming ducts, therein. The ratio of the constriction factor on the coolant side to the constriction factor on the cooling air side is approximately in the range between 0.20 and 0.44. The hydraulic diameter on the coolant side is approximately in the range between 0.8 and 1.5 mm. The inventors have found that a coolant cooler which is equipped with these features has an acceptable pressure loss accompanied by an excellent heat transmission capacity. The power per unit of weight which is achieved is particularly advantageous, that is to say the coolant cooler has a significantly lower weight. The internal insert ensures a correspondingly high level of resistance, in particular to internal pressure.

According to one advantageous development there is provision for each flat pipe to be composed of three shaped sheet metal strips, wherein two sheet metal strips form the wall of the flat pipe, and the third sheet metal strip constitutes the corrugated internal insert, forming ducts, in the same. There is specifically provision for the wall thickness of the flat pipe to be in the range of 0.10-0.20 mm. The thickness of the internal insert is in the range of 0.03-0.10 mm. Because the internal insert can be manufactured from relatively thin sheet steel, the possibility of reducing weight without adversely affecting the strength is enhanced.

On the coolant side, the constriction factor is in a range between 0.15 and 0.28. On the other hand, on the cooling air side the constriction factor is in a range between 0.63 and 0.76.

The constriction factor is calculated as a ratio of the area flowed through to the entire end area F of the respective media side.

The hydraulic diameter $d_h$ is calculated from $d_h=4\times A/U$. A is the area flowed through. U is the wetted area of the area flowed through. Further features can be found in the dependent claims.

An exemplary embodiment of the invention will be described below with reference to the appended drawings. This description contains further features and their advantages which may possibly prove to be significant later.

Figure 5:
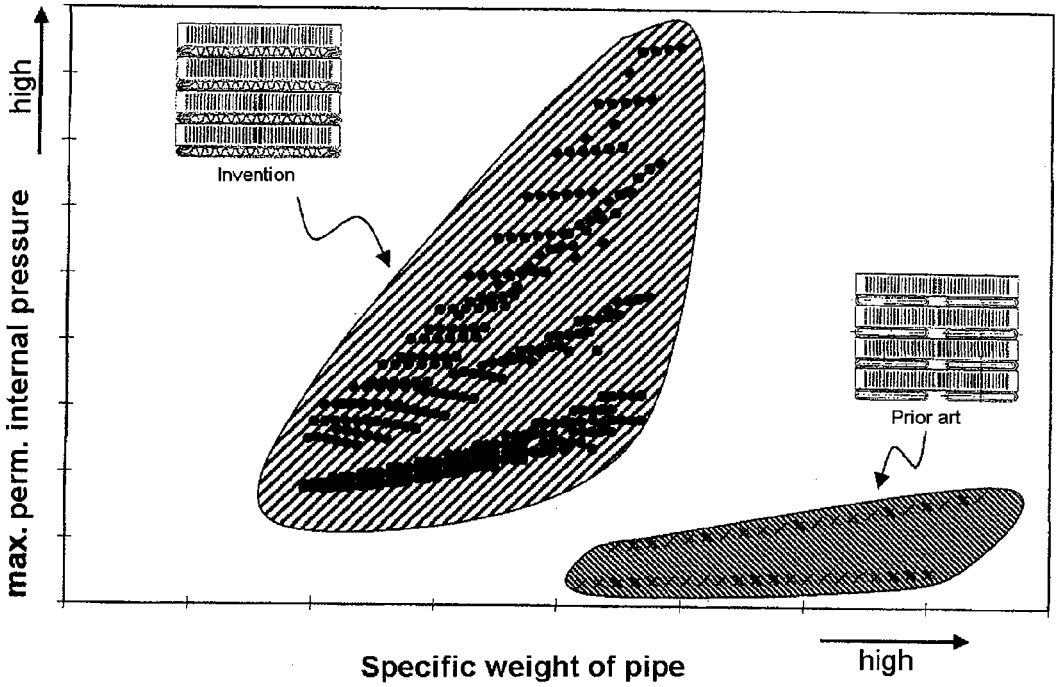
FIGS. 5-11 show diagrams of the difference between the flat pipes of the coolant cooler according to the invention and flat pipes of conventional coolant coolers in a number of respects.

FIG. 5 shows evaluations of extensive FEM trials which have been carried out by the inventors. FIG. 5 shows clearly that the flat pipes 101 of the coolant cooler according to the invention are substantially lighter (ordinate) than conventional flat pipes or coolant coolers owing to their internal insert c, which is manufactured from a sheet metal strip which is approximately 0.03-0.10 mm thick. At the same time, they can withstand relatively high internal pressures (abscissa). In terms of the internal pressure stability, the overlapping of the sheet metal strips (a, b) in the narrow sides S of the flat pipes 101, on which more details will be given below, has also proven.

Figure 6:
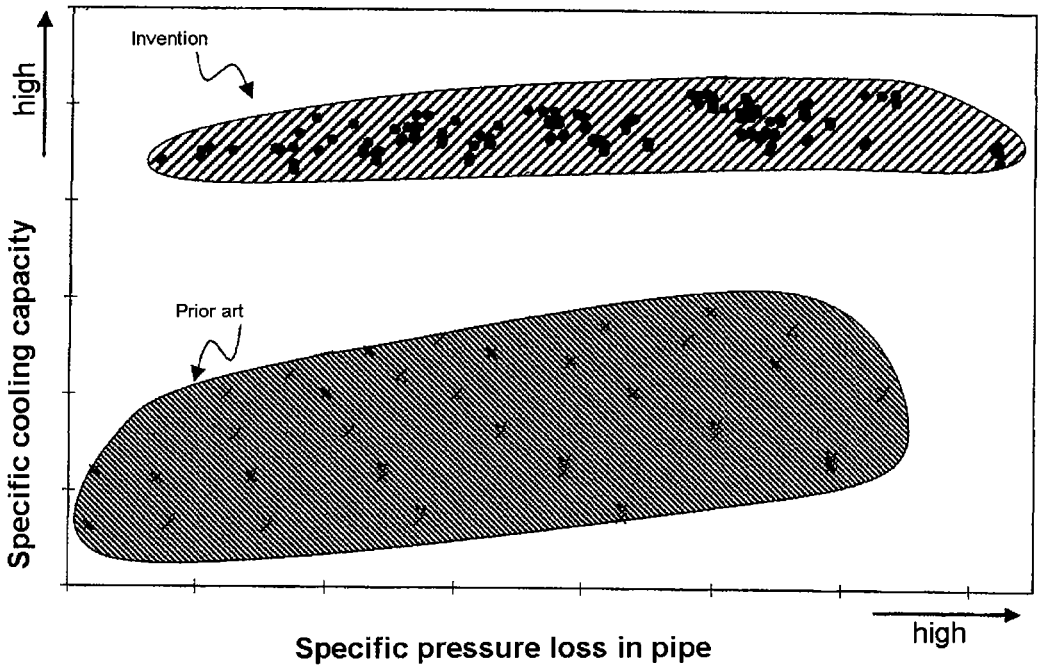
Figure 7:
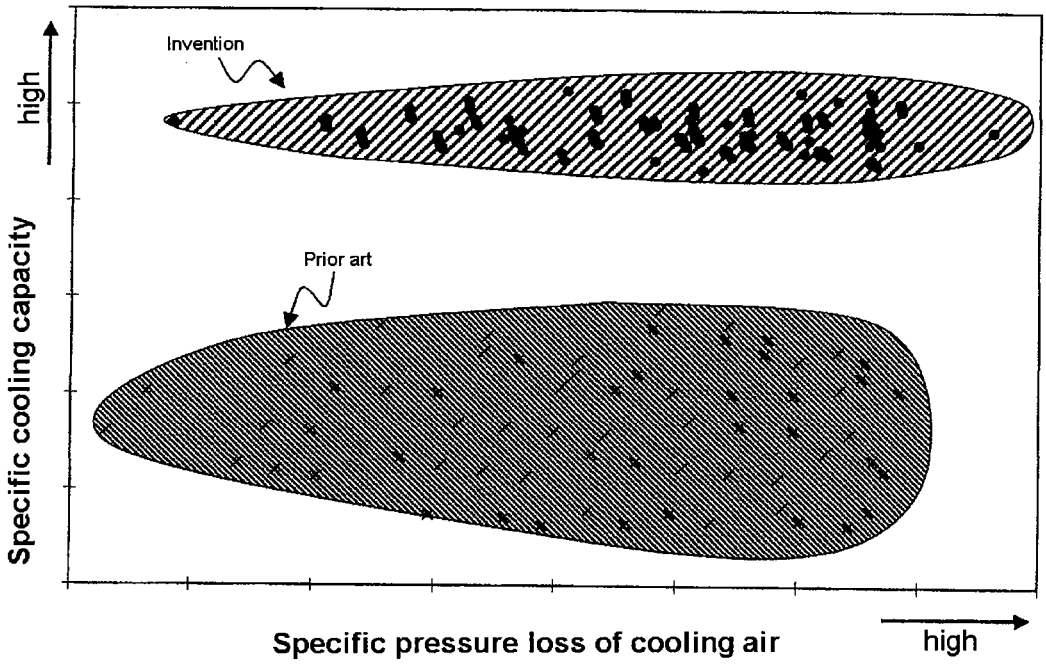

FIGS. 6 and 7 represent the evaluation of extensive thermo-hydraulic calculations. FIG. 6 makes it clear that inventive coolant coolers with such flat pipes 101 have a significantly higher specific cooling capacity than the prior art together with an approximately identical pressure loss. The first group of results represents the coolant cooler according to the invention and the one below represents the prior art. FIG. 7 provides identical information, while in contrast to FIG. 6 the pressure loss in the cooling air has been considered on the abscissa in FIG. 7. For the specific cooling capacity, the cooling capacity is referred to the input temperature difference ETD and that referred to the mass of the cooling network. The operating point was a coolant flow of 160 kg/($m^2$s) and a flow of cooling air of 8.0 kg/($m^2$s). The cooling network dimensions investigated were 600 mm flat pipe length, 445 mm network width and 32 mm network depth.

Figure 8:
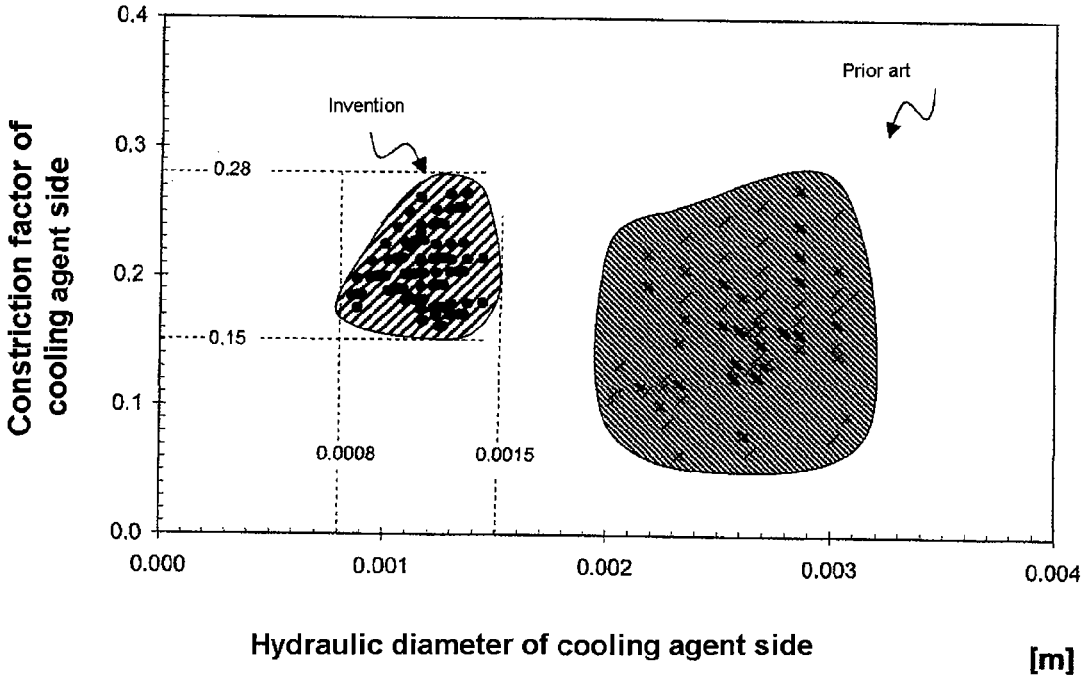

In FIG. 8, the hydraulic diameter on the coolant side, that is to say that of the flat pipes 1, is plotted on the abscissa against the constriction factor on the coolant side on the ordinate. In the figures, the term "cooling agent" was used, while in this case coolant refers to the same thing. The left-hand group of results shows the invention and the right-hand group of results shows trials from the prior art. From the illustration it is possible to conclude that the hydraulic diameters in the flat pipes 101 of the coolant cooler according to the invention are in all cases smaller than in customary coolant coolers. The inventors have found, by means of a thermo-hydraulic optimization calculation, that with the flat pipes 101 shown with an internal insert c the highest weight-specific and also volume-specific cooling capacities can be achieved with hydraulic diameters in the range between 0.8 mm and 1.5 mm and with a constriction factor on the coolant side in the range of 0.15-0.28 mm while at the same time a low cooling agent-side pressure loss can be achieved. The advantageous limiting values have already been entered using dashed lines.

Figure 9:
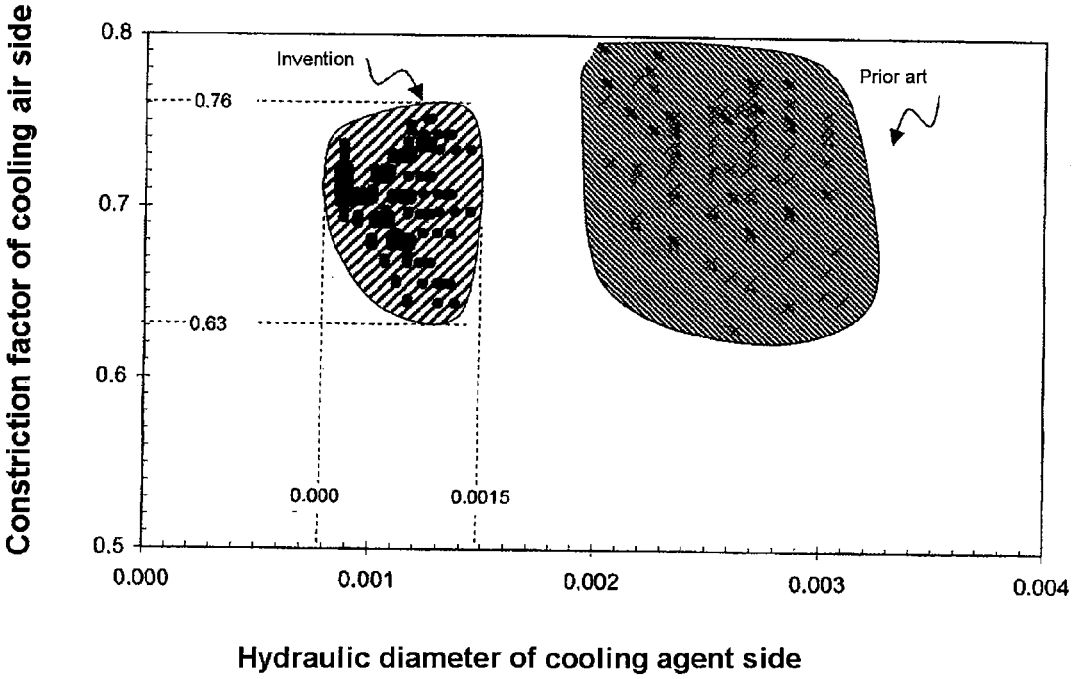

In FIG. 9 the constriction factor on the cooling air side has been plotted against the hydraulic diameter.

Figure 10:
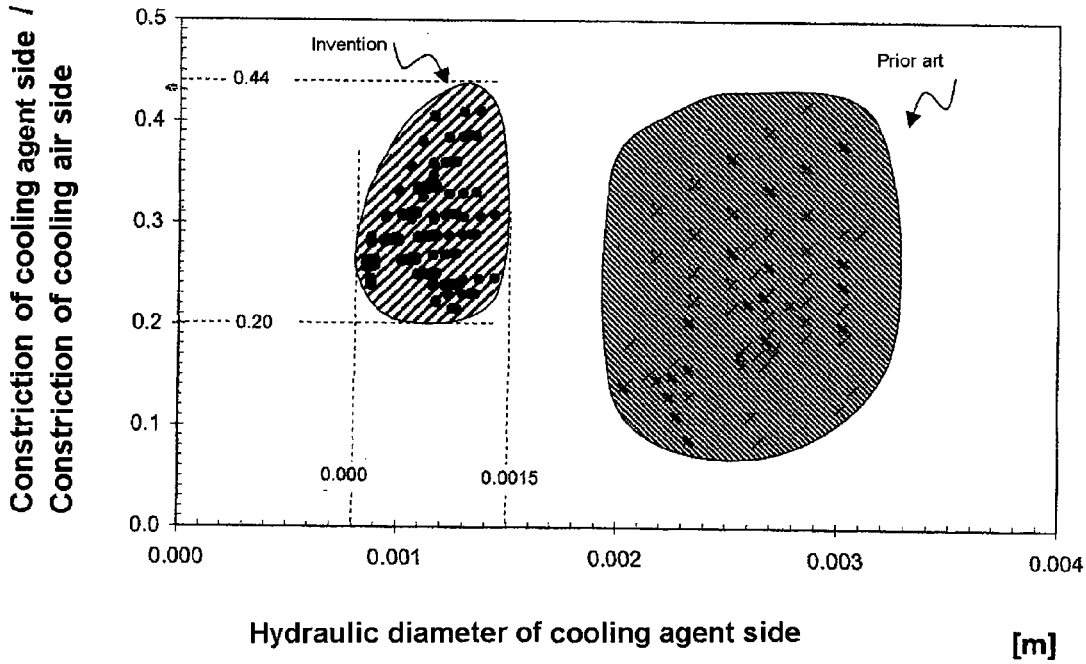

In FIG. 10, the ratio of the two constriction factors is plotted on the ordinate against the hydraulic diameters on the coolant side (abscissa). An optimum in terms of compact design, lightweight construction and performance was noted if the hydraulic diameter is approximately between 0.8 and 1.5 mm and the aforementioned ratio is in the range between 0.20 and 0.44.

Figure 11:
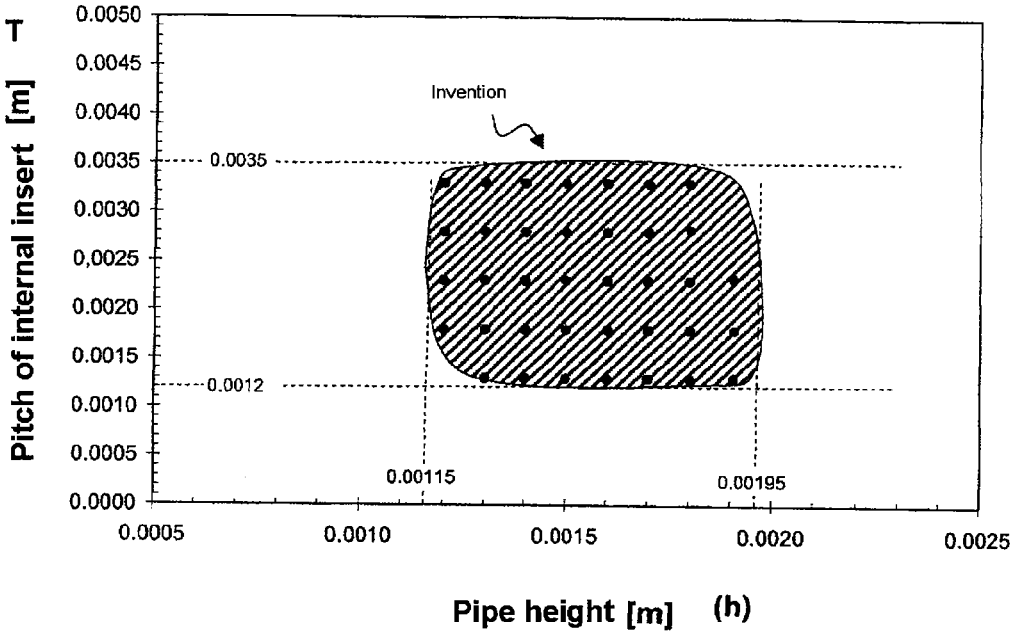

FIG. 11 is intended to show that flat pipes 11 whose internal inserts c have a pitch T (FIG. 2) between 1.2 and 3.5 mm, with a pipe height h in the range between 1.1 mm and approximately 2.0 mm have particularly frequently exhibited the advantageous properties described above.

Figure 1:
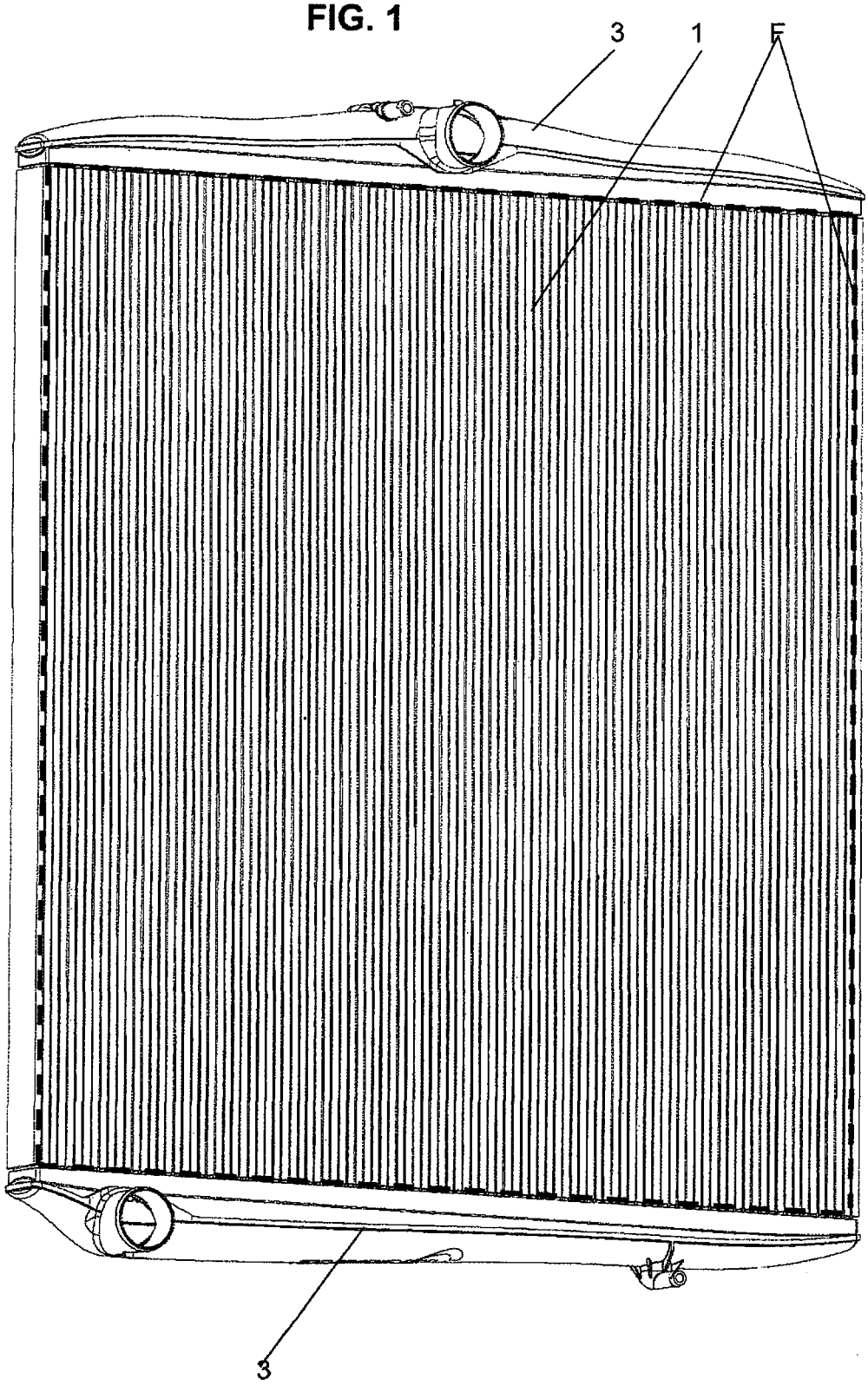
FIG. 1 shows a view of a coolant cooler according to the invention.

FIG. 1 shows a front view of the coolant cooler according to the invention. The area of the cooling network against which cooling air flows has been outlined with a dashed line. This area F is the end area which is used to determine the constriction factor on the cooling air side. The sum of the areas through which the cooling air has flowed, which are the areas of all the ribs 102 directed toward the cooling air, in other words the end area F minus the areas which are occupied by the narrow sides of all the flat pipes 101 of the cooling network, then appears on the counter.

Figure 2:
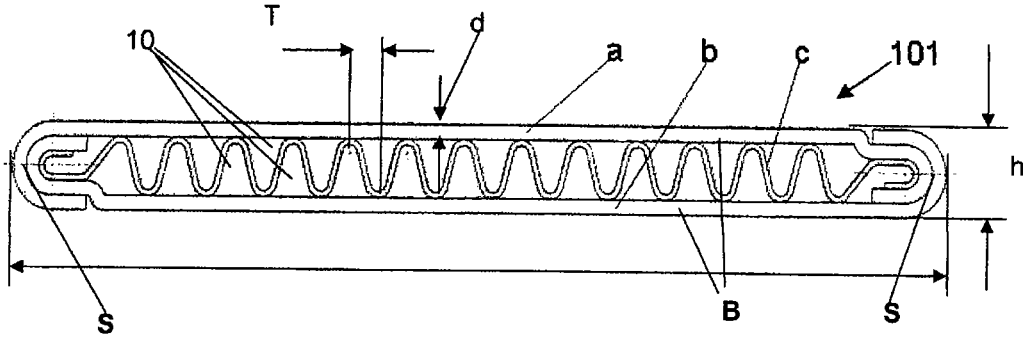
FIG. 2 shows a cross section through a flat pipe of the coolant cooler according to the invention.

FIG. 2 has shown one of the flat pipes 1 of the coolant cooler in cross section. The height h of the flat pipe multiplied by the length of the flat pipe and by the number of flat pipes 1 yields the area of the narrow sides S which is meant above. The flat pipe from FIG. 2 is manufactured from three endless sheet metal strips. Two wall parts which are rolled with curved edges are of identical design but are laterally inverted, with one edge of one of the parts engaging around one edge of the other part and the other edge of the second part engaging around the other edge of the first part. The internal insert is introduced between the two wall parts.

Figure 3:
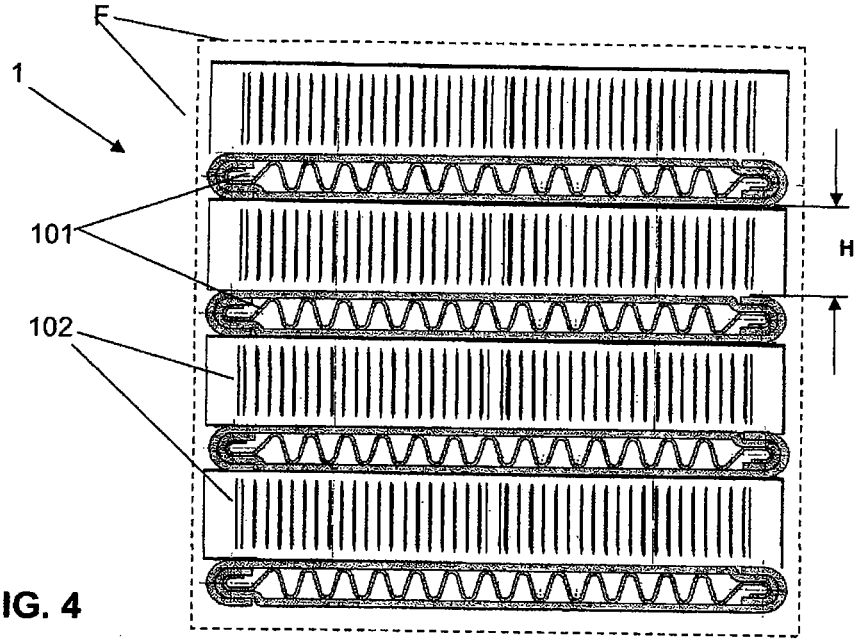
FIGS. 3 and 4 show details from the cooling network of the coolant cooler according to the invention.
Figure 4:
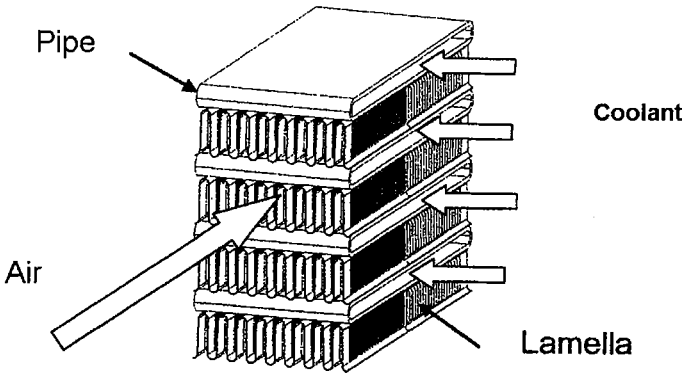

FIGS. 3 and 4 show a detail from the cooling network 1, composed of flat pipes 101 and ribs 102. The ribs 102 are what are referred to as louver-type ribs 102 which have indents in the rib edges. The indents are indicated in FIGS. 3 and 4 by means of the numerous parallel lines. A height H between 3 and 8 mm has been selected for the ribs, while for inserts in the field of passenger vehicles 3-5.2 mm is more favorable. Rib heights up to 8 mm can be used in utility vehicles, for example. In said vehicles the area F has also been indicated with a dashed line which is used to determine the coolant-side constriction factor. This area F corresponds approximately to the area which is taken up on the outside by the collector box 3. The sum of the areas occupied by the cross sections of the flat pipes is placed in a ratio to the area F and yields the constriction factor on the coolant side. The planar, that is to say unshaped broad sides B, which permit perfect soldered connections to the louver ribs 102, and which contribute perceptibly to achieving high heat transmission capacities, have also proven an advantageous construction feature of the flat pipes 101.

Figure 12:
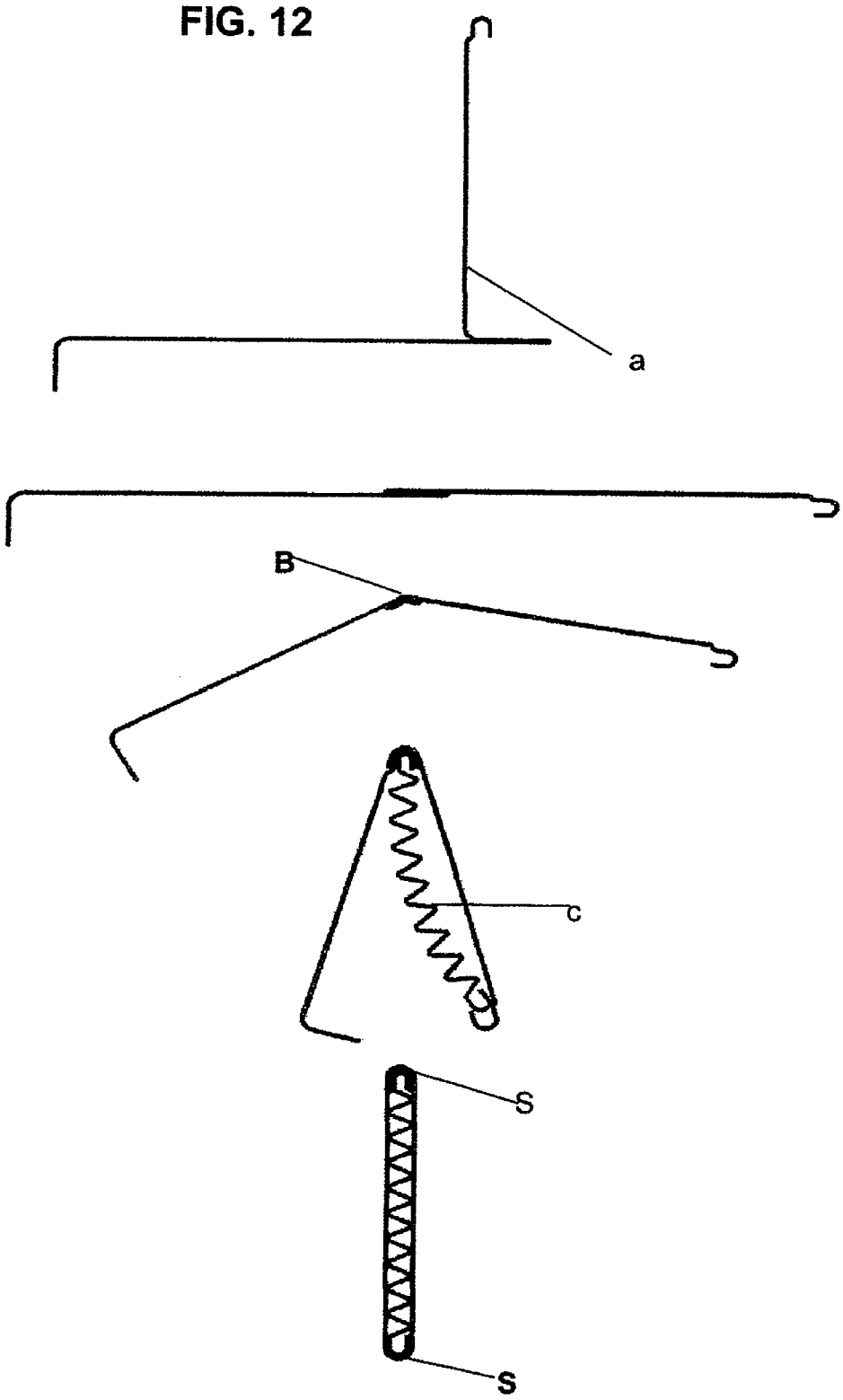
FIG. 12 shows a different flat pipe of another coolant cooler according to the invention.

FIG. 12 shows another flat pipe of the coolant cooler according to the invention which is manufactured from only two sheet metal strips a, c. The figure also shows a number of manufacturing steps and right at the bottom it shows the finished flat pipe 101. A fold is formed in one a of the endless sheet metal strips which constitutes the wall of the flat pipe. A bend B, which leads to one S of the narrow sides is made in the fold. This sheet metal strip a has a thickness of 0.12 mm. This sheet metal strip c which forms the internal insert c is approximately 0.09 mm thick. It is corrugated and placed with its longitudinal edge bearing on the inside of the aforementioned bend B. The flat pipe is closed, with the second narrow side S being constricted by placing the shaped longitudinal edges of one a of the sheet metal strips one in the other. All flat pipes have the advantage that their narrow sides S are very stable despite the small sheet metal thicknesses, as is shown by FIGS. 2 and 12.

The invention claimed is:

1. A coolant cooler for motor vehicles having a soldered cooling network, the cooler comprising:

flat pipes and ribs formed from thin sheets of aluminum and having collector boxes arranged at ends of the flat pipes for receiving coolant which flows in the flat pipes and which is cooled by air flowing across the ribs, wherein each flat pipe is composed of at least two shaped sheet metal strips, wherein at least one of the sheet metal strips forms a wall of the flat pipe and the other sheet metal strip constitutes a corrugated internal insert, forming ducts, therein, and in that the ratio of the constriction factor on the coolant side to the constriction factor on the cooling air side is between 0.20 and 0.44, wherein the hydraulic diameter on the coolant side is between 0.8 and 1.5 mm.

2. The coolant cooler according to claim 1, wherein each flat pipe is composed of three shaped sheet metal strips, wherein two sheet metal strips form the wall of the flat pipe, and the third sheet metal strip constitutes the corrugated internal insert in the same.

3. The coolant cooler according to claim 1, wherein the wall thickness of the flat pipe is between 0.10 mm and 0.25 mm, and wherein the thickness of the internal insert is between 0.03 mm and 0.10 mm.

4. The coolant cooler according to claim 1, wherein the constriction factor on a coolant side is between 0.15 and 0.28.

5. The coolant cooler according to claim 1, wherein the constriction factor on the cooling air side is between 0.63 and 0.76.

6. The coolant cooler according to claim 1, wherein the thickness of the ribs is not greater than 0.08 mm, and wherein the height of the ribs is between 3.0 mm and 8.0 mm.

7. The coolant cooler according to claim 1, wherein the two sheet metal strips of the flat pipe are substantially identical in construction, have a first longitudinal edge with a relatively large arc and a second longitudinal edge with a relatively small arc, wherein the two sheet metal strips are arranged laterally and vertically with respect to one another, in that the two sheet metal strips which run parallel are joined, wherein the corrugated internal insert is introduced between the two sheet metal strips, wherein the sheet metal strips engage one another at their arcs, wherein the relatively large arc of the one part engages around the relatively small arc of the other part and the relatively large arc of the other part engages around the relatively small arc of the one part.

* * * * *

UNITED STATES PATENT AND TRADEMARK OFFICE

CERTIFICATE OF CORRECTION

PATENT NO. : 8,522,862 B2
APPLICATION NO. : 12/669264
DATED : September 3, 2013
INVENTOR(S) : Opferkuch et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 862 days.

Signed and Sealed this
Fifteenth Day of September, 2015

Michelle K. Lee

Michelle K. Lee
*Director of the United States Patent and Trademark Office*